United States Patent [19]

Larson

[11] 3,986,483

[45] Oct. 19, 1976

[54] ROTARY INTERNAL COMBUSTION ENGINE

[76] Inventor: Dallas J. Larson, 2001 S. 2300 East, Salt Lake City, Utah 84108

[22] Filed: Nov. 19, 1975

[21] Appl. No.: 633,346

Related U.S. Application Data

[63] Continuation of Ser. No. 513,243, Oct. 9, 1974, abandoned.

[52] U.S. Cl. ..... 123/8.45; 123/43 C; 418/176; 418/261

[51] Int. Cl.[2] ..... F02B 55/14

[58] Field of Search ..... 123/8.45, 43 AA, 43 C, 123/44 E; 418/176, 261, 245, 175, 186, 187, 260, 244, 264

[56] References Cited

UNITED STATES PATENTS

| | | | |
|---|---|---|---|
| 859,744 | 7/1907 | Cottrell | 418/175 |
| 1,225,056 | 5/1917 | Riggs | 123/8.45 |
| 1,770,225 | 7/1930 | Blackman | 418/175 |
| 2,435,476 | 2/1948 | Summers | 123/8.45 |
| 3,181,512 | 5/1965 | Hapeman | 123/8.45 |
| 3,824,968 | 7/1974 | Brumagim | 123/8.45 |
| 3,855,977 | 12/1974 | Statkus | 418/264 |

FOREIGN PATENTS OR APPLICATIONS

| | | | |
|---|---|---|---|
| 629,349 | 3/1963 | Belgium | 123/8.45 |
| 69,284 | 9/1891 | Germany | 418/260 |
| 275,096 | 6/1930 | Italy | 123/8.45 |

*Primary Examiner*—Clarence R. Gordon
*Attorney, Agent, or Firm*—Lynn G. Foster

[57] ABSTRACT

A rotary internal combustion engine includes an annular stator member having two pairs of sockets located in the periphery thereof, and a rotor member mounted to rotate about the stator member. The rotor member has side walls and an interior peripheral wall which, in cooperation with the periphery of the stator member, define a combustion cavity and a compression cavity therebetween. The combustion cavity and compression cavity are disposed on opposite sides of the stator member adjacent the periphery thereof. Two pairs of wedge-shaped vanes are pivotally mounted at their vertices on the periphery of the stator member to pivot in and out of respective ones of the sockets as the rotor member is caused to rotate about the stator member. A cam track is defined in the side walls of the rotor member to guide cam followers extending from the sides of each vane such that the vanes are caused to pivot in and out of the sockets and to maintain sliding contact with the interior peripheral wall of the rotor member. As the rotor member rotates and the vanes pivot in and out of the sockets, the space between the vanes successively increases and decreases. A fuel mixture is introduced into the space between the vanes when the rotor member is rotated to a point where the space coincides with a portion of the compression chamber. As the rotor member continues to rotate, this space and the fuel mixture is compressed and at a point where the space coincides with a portion of the combustion chamber, the fuel mixture is ignited. Igniting the fuel mixture causes the rotation and shortly after combustion of the fuel mixture, the combustion products are exhausted from the space between the vanes.

12 Claims, 5 Drawing Figures

ROTARY INTERNAL COMBUSTION ENGINE

CONTINUITY

This application is a streamline continuation of my copending U.S. Patent Application Ser. No. 513,243, filed Oct. 9, 1974, now abandoned.

BACKGROUND OF THE INVENTION

This invention relates to rotary internal combustion engines and more particularly to a rotary engine in which at least a pair of pivotal vanes define the combustion chamber.

The concept of a rotary engine having rotating rather than reciprocating parts has long been of interest to engine designers. One of the continuing problems in the attempts to find a suitable rotary engine configuration is that of developing an acceptable structure for defining the combustion chamber or chambers of the engine. One approach has been to position one or more generally flat vanes in a rotor so that the vanes reciprocate in and out of the rotor as the rotor turns inside an outer casing. Fuel is introduced between the rotor and the casing and ignited to operate against the vanes and thereby cause the rotor to turn. See for example U.S. Pat. Nos. 1,354,189 and 2,345,651. One problem with these arrangements is that since the vanes receive most of the force produced by igniting the fuel, the vanes tend to rapidly wear and become deformed. Further, it is generally difficult to produce the desired compression of the fuel mixture prior to combustion.

One arrangement for improving the compression and combustion capability of rotary engines utilizing vanes is disclosed in U.S. Pat. No. 2,118,253. In this arrangement, the fuel mixture is compressed between two spaced apart, generally flat vanes disposed in a rotor body. The vanes are radially offset so that the rotor body receives a greater portion of the force of combustion than with arrangements in which the vanes are radially positioned. However, the vanes still receive a significant portion of the force of the combustion and, because of their generally flat configuration, tend to easily deform.

An arrangement utilizing a generally triangular-shaped vane or piston, rather than the flat-shaped vanes, is disclosed in U.S Pat. No. 2,435,476. Each vane or piston of this arrangement operates independently of the other vanes and the compression of the fuel mixture is not obtained by any action of the vanes but rather the fuel mixture is compressed prior to injection into the combustion chambers. This latter feature increases the complexity and cost of the engine.

In the typical prior art rotary engine arrangement, many of the moving parts (for example the vanes) are mounted in the rotating member of the engine resulting in these parts being subject to significant centrifugal forces which increases the wear on such parts. Another common problem with the prior art arrangements arises from the need to lubricate the engine. In order for a lubricant to be applied to the rotating member of the engine, the lubricant must be supplied in some manner through the inside of the member; otherwise, the centrifugal force of the member will prevent the application of lubricant to it. However, even if the lubricant is provided through the inside of the rotating member, the centrifugal force tends to throw the lubricant from the rotating member causing inordinate lubricant losses.

SUMMARY OF THE INVENTION

It is an object of the present invention, in view of the abovedescribed prior art arrangements, to provide a new and improved rotary engine structure.

It is another object of the present invention to provide a rotary engine structure in which component parts employed to define the combustion chamber will readily withstand deformation.

It is still another object of the present invention to provide a rotary engine in which the action of a pair of pivotal vanes cooperate to suitably compress therebetween a fuel mixture prior to combustion.

It is a further object of the present invention to provide a rotary engine in which the rotating member contains substantially none of the moving parts of the engine.

It is still a further object of the present invention, in accordance with one aspect thereof, to provide a rotary engine constructed in a generally symmetrical fashion so that the actions of the moving parts thereof are substantially balanced.

The above and other objects and advantages of the invention are realized in a specific illustrative embodiment which includes a generally annular stator member having a pair of spaced apart sockets located in the periphery thereof, and a rotor member mounted to rotate about the stator member and formed to define a combustion cavity and a compression cavity between an interior peripheral wall of the rotor member and the periphery of the stator member. A pair of spaced apart wedge-shaped vanes are pivotally mounted at their vertices on the periphery of the stator member to pivot in and out of respective ones of the sockets as the rotor member rotates. The pivoting action of the vanes operates to successively enlarge and reduce the space between the vanes and thereby provide for compressing a fuel mixture introduced therebetween and for expansion of the mixture when ignited. A cam truck is defined in a side wall of the rotor member to guide cam followers extending from the vanes to cause the vanes to pivot in and out of sockets and maintain sliding contact with the interior peripheral wall of the rotor member.

In accordance with one aspect of the invention, a second pair of wedge-shaped vanes, similar to the first pair, is pivotally mounted at their vertices on the periphery of the stator member opposite the first pair of vanes and are adapted to pivot in and out of a second pair of sockets located in the stator member to balance the pivoting action of the first pair of vanes.

Utilization of wedge-shaped vanes provides a structure which readily withstands deformation and which suitably defines compression and combustion chambers for operation of the engine. Further, with the moving parts of the engine (except for the rotor member) located in the stator member rather than the rotor member, much less wear occurs.

BRIEF DESCRIPTION OF THE DRAWING

The above and other objects, advantages and features of the present invention will become apparent from a consideration of the following detailed description presented in connection with the accompanying drawings in which.

DETAILED DESCRIPTION

Figure 1A:
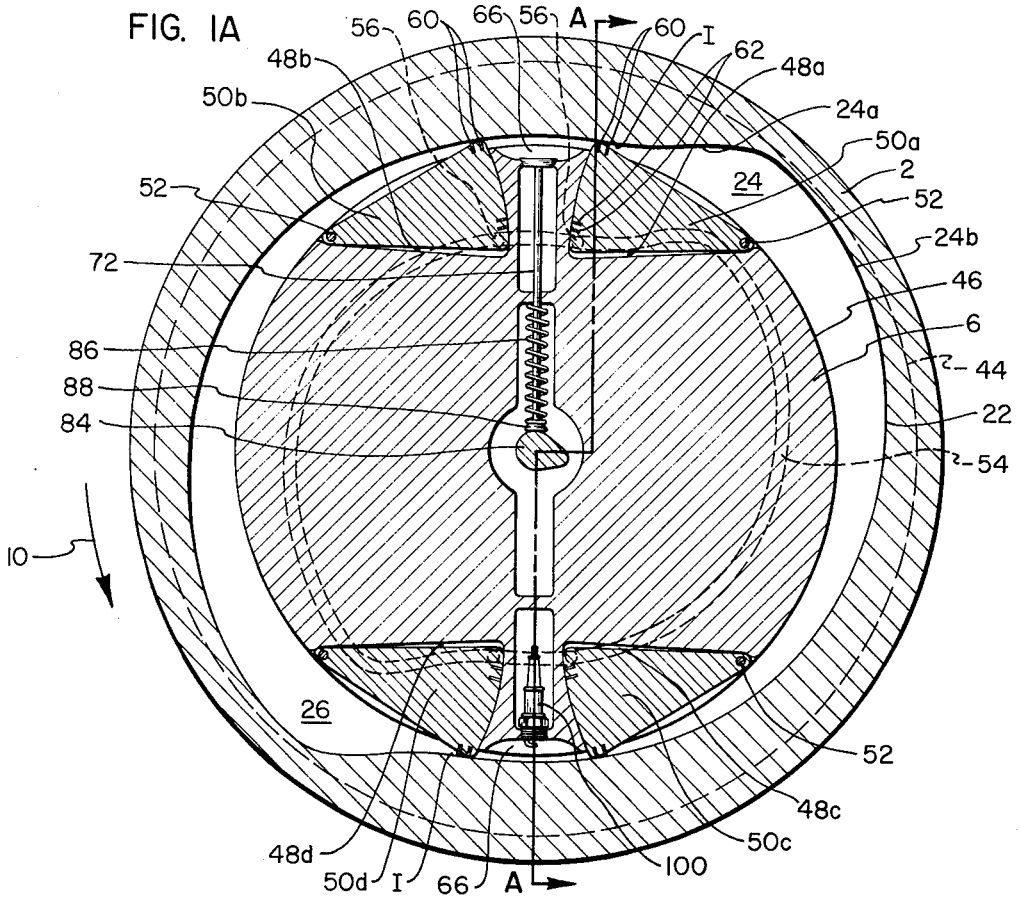
FIGS. 1A through 1C are side cross-sectional views of a rotary engine made in accordance with the principles of the present invention, showing different positions of a rotor member of the engine.

Referring to FIG. 1A, there is a side cross-sectional view of a rotary engine which includes a rotor member 2 adapted to circumscribe and rotate about a generally annular stator member 6. The direction of rotation of the rotor member 2 is counterclockwise as indicated by the arrow 10. The rotor member 2 is formed to include side walls 14 and 18 (see FIG. 3) and an interior peripheral wall 22. The interior wall 22 of the rotor member 2 is contoured (see FIG. 1A) to define, in cooperation with the periphery of the stator member 6, a pair of similarly shaped cavities 24 and 26, the first of which is a combustion cavity in which ignition of a fuel mixture occurs, and the second of which is a compression cavity in which the fuel mixture is compressed prior to combustion. The cavities 24 and 26 are positioned oppositely each other in the rotor member 2. Beginning at point I on the interior peripheral wall of the rotor member 2 and moving in the clockwise direction, it is seen that the interior peripheral wall first curves generally outwardly away from the periphery of the stator member 6 in a slightly convex fashion to define a steep wall 24*a*. The interior peripheral wall then curves gradually toward and about the periphery of the stator member 6 in a concave fashion to define wall 24*b*. The wall 24*a* of the combustion chamber 24 forms a much steeper incline than does wall 24*b* as can be seen in FIG. 1A.

Figure 3:
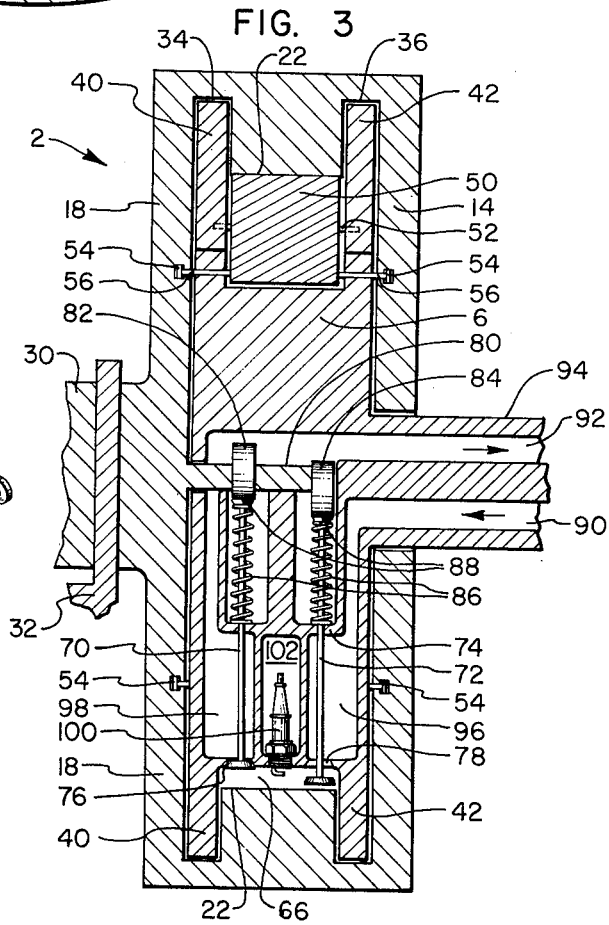
FIG. 3 is a front cross-sectional view of the engine, taken along lines A—A of FIG. 1A.

As best seen in FIG. 3, the rotor member 2 includes a shaft 30 extending from one side thereof and journaled to rotate in a bearing 32. In use, the shaft 30 would be coupled to whatever mechanism was to be driven by the engine. Although the rotor member 2 is shown journaled to rotate in a bearing 32, a variety of arrangements could be provided for mounting the rotor member to enable rotation thereof.

As also best seen in FIG. 3, the interior of the rotor member 2 includes axially spaced grooves 34 and 36 for receiving side flanges 40 and 42 respectively of the stator member 6. These flanges are indicated by dotted line 44 in FIG. 1A. The flanges, as indicated in FIG. 1A, extend radially outward further than the periphery 46 of the central portion of the stator member 6 which, as will next be discussed, carries the moving parts of the engine. (Hereafter, when speaking of the periphery of the stator member 6, the periphery 46 of the central portion of the stator member will be intended.)

Figure 1B:
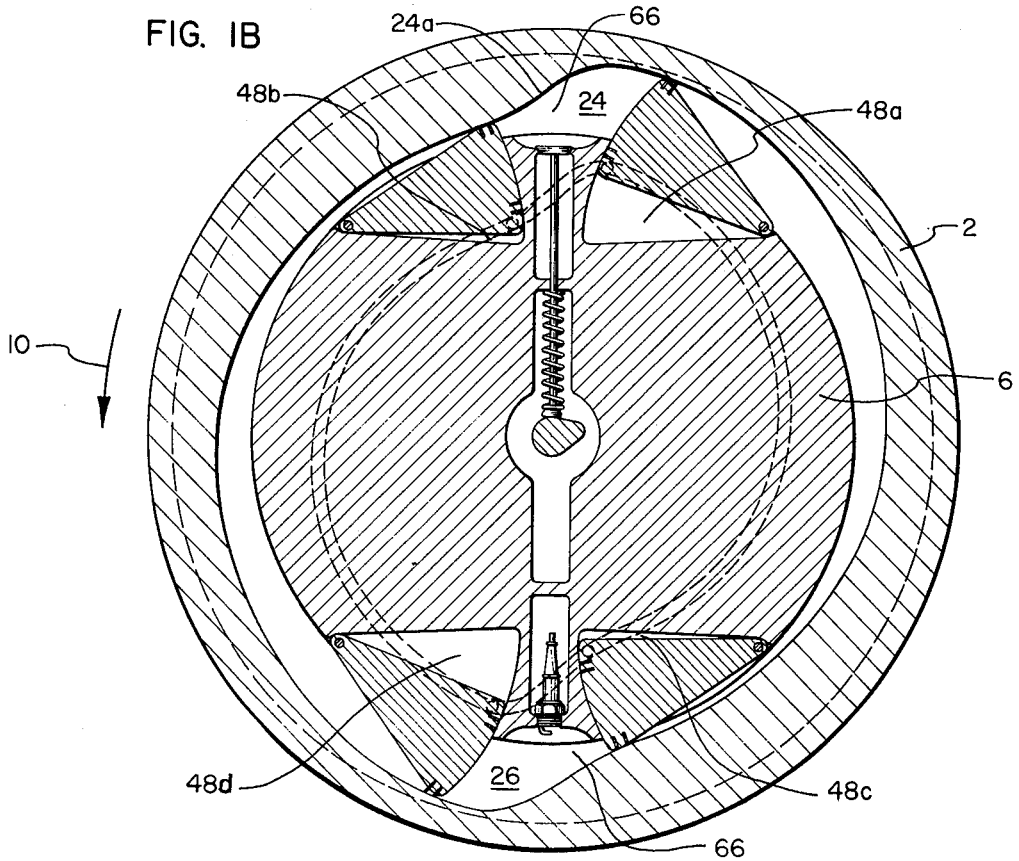
Figure 1C:
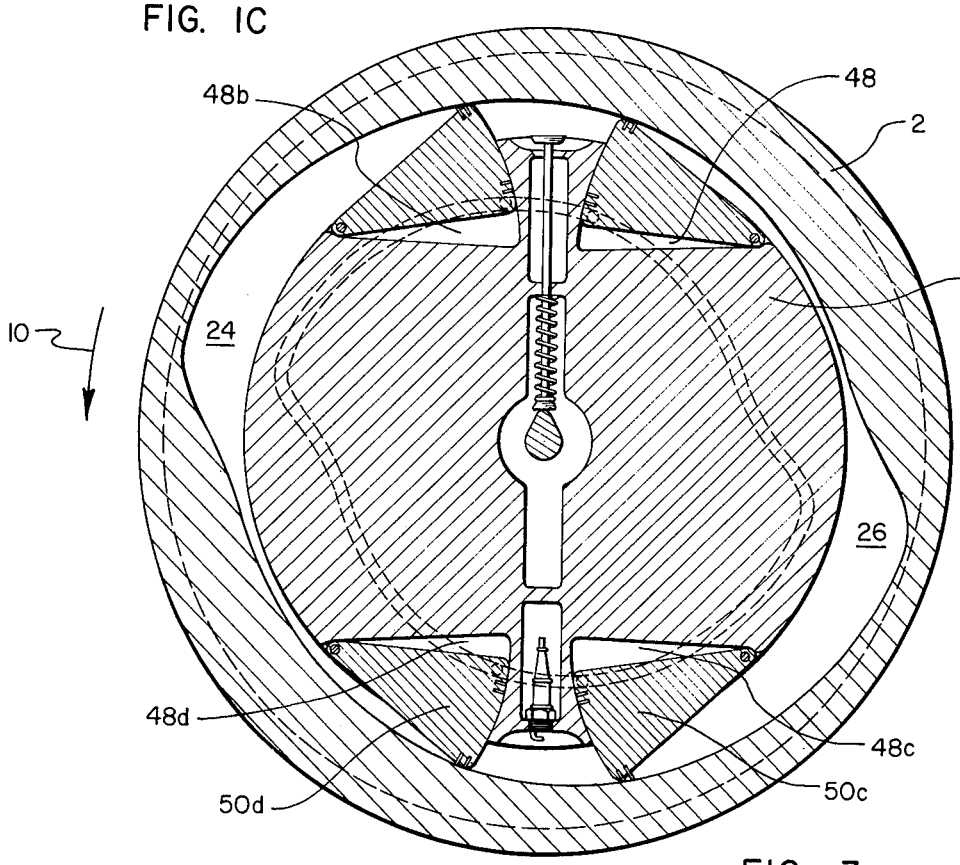

Located in the periphery of the stator member 6 are two pairs of spaced apart sockets 48*a* through 48*d*. These sockets are wedge-shaped (as better shown in FIGS. 1B and 1C) and are positioned so that the bases of the wedges are generally adjacent one another. The sockets are contoured to conform to corresponding wedge-shaped vanes 50*a* through 50*d* which are mounted in the stator member 6 to pivot at their apexes about pins 52 extending, for example, between the side flanges 40 and 42 of the stator member (see FIG. 3). The vanes are mounted to pivot in and out of their corresponding sockets as the rotor member 2 rotates about the stator member 6 so that an outer surface of each vane is maintained in contact with the interior peripheral wall 22 of the rotor member 2. FIGS. 1B and 1C show various vanes pivoted out of corresponding sockets and into the combustion cavity 24 and compression cavity 26.

The vanes 50 are caused to pivot in and out of their sockets and to maintain contact with the interior peripheral wall 22 of the rotor member by cam tracks 54 (shown by dotted line in FIGS. 1A through 1C) defined in the side walls 14 and 18 of the rotor member (see FIG. 3). Cam follower pins 56 extend from either side of each vane and through the side flanges 40 and 42 to fit within and follow the track 54. Note that the track 54 has the same contour as the interior wall 22 of the rotor member 2 to cause the vanes 50 to pivot and maintain contact with the interior wall.

Figure 2:
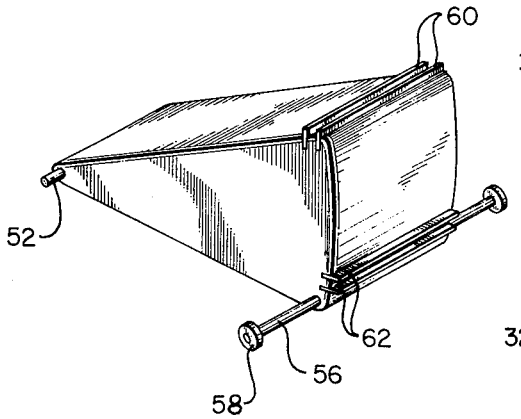
FIG. 2 is a perspective view of one of the vanes.

FIG. 2 shows a perspective view of an exemplary wedge-shaped vane. The vane there shown includes a pivot pin 52 extending from either side of the vane near the apex thereof, and a cam follower pin 56 extending from either side of the vane near the base thereof. The cam follower pin 56 carries rollers 58 at either end thereof which fit within the track 54 and facilitate the track following operation. At the upper portion of the vane near the base thereof are a pair of sealing inserts 60 (corresponding to rings of a conventional piston engine) fitted into slots in the vanes. These sealing inserts maintain contact with interior wall 22 of the rotor member 2 to seal the chamber defined between the pairs of vanes. A second pair of sealing inserts 62 are fitted in slots in the base of the vane near the cam follower pin 56 to contact the base wall of a corresponding socket in which the vane is fitted. The sealing inserts are also shown in FIGS 1A through 1C.

Each pair of vanes is positioned in the stator member 6 to define a chamber 66 (see FIG. 1A) therebetween into which a fuel mixture is injected and in which combustion takes place. These chambers are defined between the base surfaces of the vanes, the interior peripheral wall 22 of the rotor member 2, and the periphery of the stator member 6. The stator member 6 is formed to provide a depression between each pair of vanes to accommodate definition of the chambers 66.

Portions of the interior of the stator member 6 are hollowed out to carry various components necessary to the operation of the engine. These components include two pairs of valves (only one pair of valves 70 and 72 being shown in FIG. 3) extending from near the center of the stator member 6 between corresponding pairs of vanes into the chambers 66. The construction of valves 70 and 72 will be described, it being understood that the construction of the other pair of valves is similar in construction. The stems of the valves 70 and 72 pass through and are carried by a partition 74 in the stator member 6 to enable the valves to seat in ports or valve openings 76 and 78 located in the periphery of the stator member 6 between two vanes. The valves 70 and 72 are operated by a cam shaft 80 extending from one side wall of the rotor member 2 into the interior of the stator member 6. The cam shaft 80 carries two cams 82 and 84 to actuate valves 70 and 72, respectively. Springs 86 are coiled about the stems of the valves between the partition 74 and corresponding bases 88 of the valves to maintain the valve bases against respective cams 82 and 84.

As the rotor member 2 rotates causing the cams 82 and 84 to rotate, the valves 70 and 72 are successively moved through open and closed positions to allow fuel mixtures to pass into the chamber 66 between vanes and to allow combustion products to exhaust from the chamber. Fuel mixtures are introduced to the chamber through a duct 90 located in a shaft 94 extending from one side of the stator member 6. The duct 90 extends along the interior of the shaft 94 and through an interior passage 96 in the stator member to the port 78 leading to the chamber 66. When the valve 72 is opened, as it is shown in FIG. 3, a fuel mixture is allowed to pass through the port 78 into the chamber 66. After the valve 72 is closed and combustion takes place in the chamber 66, valve 70 is opened to allow the combustion products to pass through the port 76, through another interior passage 98, and out a duct 92 also located in the shaft 94. Arrows shown in the ducts 90 and 92 indicate the direction of travel of the fuel mixture and combustion products. Although FIG. 3, as already mentioned, shows only one pair of valves and the cavities in which the valves are mounted, it should be understood that a similar pair of valves oppositely disposed in the stator member 6 is also provided.

Sparkplugs 100 are located between each pair of valves and each pair of vanes to ignite the fuel mixture introduced into the chambers 66. Each sparkplug 100 is positioned in a cavity 102 in the stator member 6 so that the points of the sparkplug extend into a corresponding chamber 66.

The operation of the engine will now be described with reference being made to FIGS. 1A through 1C. Assume that the rotor member 2 is in the position shown in FIG. 1A in which the vanes **50*a* through 50*d* are pivoted substantially into their respective sockets and the chambers 66 between the vanes are narrowly confined by the interior peripheral wall 22 of the rotor member 2. As the rotor member 2 moves in the counterclockwise direction, vanes 50*c* and 50*d* begin to pivot outwardly into the compression cavity 26 to, in effect, enlarge the chamber 66 located between the vanes (see FIG. 1B). Coincident with enlargement of this chamber, an intake valve (not shown in FIGS. 1A through 1C) is opened to allow a fuel mixture to be drawn into the chamber 66. The fuel mixture is drawn into the chamber until the compression cavity 26 begins to narrow at which time the intake valve is closed (see FIG. 1C). As the rotor member 2 continues to rotate, the compression cavity 26 continues to narrow causing a decrease in the volume of the chamber 66 between the vanes 50*c* and 50*d* so that the fuel mixture introduced thereinto is compressed. When the rotor member 2 is rotated to a point just prior to or where the combustion cavity 24 begins to enlarge, the fuel mixture between the vanes 50*a* and 50*d* is ignited creating a force which operates against the steep wall 24*a* of the combustion cavity 24 causing the rotor member 2 to continue its counterclockwise rotation. An exhaust operation would then begin for the combustion products created between the vanes 50*c* and 50*d*. However, since vanes 50*a* and 50*b* are shown in FIG. 1A in a position at or near the point of combustion, the exhaust operation will be described with respect to vanes 50*a* and 50*b*.**

Assuming combustion has occurred between vanes **50*a* and 50*b*, as the rotor member 2 is in the position shown in FIG. 1B, the combustion cavity 24 has enlarged allowing the cavity 66 between the vanes 50*a* and 50*b* to similarly enlarge. Enlargement of the cavity 66 between the vanes 50*a* and 50*b* allows for expansion of the ignited fuel mixture and the generation of the force against the steep wall 24*a* of the combustion cavity 24. While this expansion is taking place, both the intake and exhaust valves are closed. When the rotor member 2 reaches a point of maximum enlargement of the chamber 66 between the vanes 50*a* and 50*b* and the combustion cavity 24 begins to narrow, the exhaust valve between the vanes 50*a* and 50*b* is opened by a cam to allow the combustion products to be forced from the chamber 66 (see FIG. 1C). Continued rotation of the rotor member 2 results in a decrease in the volume of the chamber 66 because of the narrowing of the combustion cavity 24 and this operates to force the combustion products from the chamber, through an exhaust port and out the exhaust duct 92 (FIG. 3). When the rotor member 2 is moved to a point where the beginning of the compression cavity 26 is positioned just above the vanes 50*a* and 50*b*, then the intake cycle, described earlier for vanes 50*a* and 50*d*,** would be initiated.

Because of the symmetrical configuration of the combustion cavity 24 and compression cavity 26 and the positioning of the pairs of vanes on opposite edges of the periphery of the stator member 6, the pivoting outwardly of one pair of vanes is balanced by a corresponding outward pivoting of the other pair of vanes. The advantage of this counter balancing, of course, is that vibration in the engine is significantly reduced Also, since substantially all moving parts of the engine are located in the stator member 6 rather than the rotor member 2, stress, strain and wear on these parts is reduced.

Forming the vanes into wedge-shaped elements and then positioning each pair of vanes so that the base of one vane of a pair generally faces the base of the other vane of the pair provides a sturdy structure for defining the combustion chambers. The wedge-shaped vanes, because of their structure, are not easily deformed by the combustion of fuel in the chamber between the vanes.

Provision of an outer rotating member allows for introducing lubrication through an inner static member and this would serve to reduce the loss of oil which might otherwise occur from centrifugal forces impressed on the oil if the interior member rotated.

It is to be understood that the above-described arrangement is only illustrative of the application of the principles of the present invention. Numerous other modifications and alternative arrangements may be devised by those skilled in the art without departing from the spirit and scope of the present invention, and the appended claims are intended to cover such modifications and arrangements.

What is claimed is:

1. A rotary engine comprising a generally annular stator member having a shaft extending from one side thereof and a first pair of spaced apart sockets located in the periphery of the stator member, a rotor member mounted to rotate about said stator member, said rotor member having side walls and a peripheral wall, said peripheral wall formed to define a combustion cavity and a compression cavity between the peripheral wall and the periphery of the stator member, said cavities being spaced apart about the periphery of the stator member, a first pair of spaced apart wedge-shaped vanes pivotally mounted at their vertices on the periphery of the stator member to pivot in and out of respective ones of said sockets as said rotor member rotates about the stator member, to thereby successively enlarge and reduce the space between the vanes, a cam track defined in at least one side wall of said rotor member, cam followers extending from at least one side of each vane and guided by said cam track to cause said vanes to pivot in and out of said sockets and maintain sliding contact with the peripheral of said rotor member, means for introducing a fuel mixture into the space between the vanes when the rotor member is rotated so that the vanes are positioned in the compression cavity, means for igniting the fuel mixture when the rotor member is rotated to a position in which the vanes are pivoted into the sockets and the space therebetween is reduced to compress the mixture, and means for exhausting the combustion products from the space between the vanes when the rotor member is rotated so that the vanes are positioned in the combustion cavity.

2. A rotary engine as in claim 1 wherein said stator member has a second pair of spaced apart sockets located in the periphery thereof opposite said first pair of sockets, said engine further comprising a second pair of spaced apart wedge-shaped vanes pivotally mounted at their vertices on the periphery of the stator member opposite said first pair of vanes, said second pair of vanes being arranged to pivot in and out of respective ones of said second sockets coincidentally with the pivoting of said first pair of vanes to thereby counterbalance the action of said first pair of vanes.

second cam followers extending from at least one side of each of the second pair of vanes and guided by said cam track to cause said second pair of vanes to pivot in and out of said second pair of sockets and maintain sliding contact with the peripheral wall of said rotor member, means for introducing a fuel mixture into the space between the second pair of vanes when the rotor member is rotated so that the second pair of vanes are positioned in the compression cavity, means for igniting the fuel mixture introduced in the space between the second pair of vanes when the rotor member is rotated to a position in which the second pair of vanes are pivoted into the second pair of sockets and the space therebetween is reduced to compress the mixture, and means for exhausting the combustion products from the space between the second pair of vanes when the rotor member is rotated so that the vanes are positioned in the combustion cavity.

3. A rotary engine as in claim 2 wherein each vane is positioned so that the base thereof faces the base of a corresponding vane to define a space therebetween for receiving the fuel mixture.

4. A rotary engine as in claim 2 wherein the position of the peripheral wall of the rotor member defining said compression cavity has substantially the same contour as the portion of the peripheral wall defining the combustion cavity.

5. A rotary engine as in claim 4 wherein the portions of the peripheral wall of the rotor member defining each cavity first curve, beginning at one end of the cavity, generally outwardly away from the periphery of the stator member in a generally convex fashion and then, in the direction of the other end of the cavity, curve toward and about the said periphery in a generally concave fashion.

6. A rotary engine as in claim 2 wherein the shaft of said stator member has a first duct therein for conducting the fuel mixture from a fuel supply to said fuel mixture introducing means, and a second duct therein for conducting the combustion products from the exhausting means out of the engine.

7. A rotary engine as in claim 6 wherein said fuel mixture introducing means comprises first and second ports in the periphery of said stator member between the vanes of said first and second pairs of vanes respectively, and first and second passages located in said stator member for communicating with said first and second ports respectively and with said first duct.

8. A rotary engine as in claim 7 wherein said fuel mixture introducing means further comprises first and second valves disposed in said first and second ports respectively, and a cam shaft extending from one side of said rotor member into said stator member to actuate said valves.

9. A rotary engine as in claim 6 wherein said exhausting means comprises third and fourth ports in the periphery of said stator member between the vanes of said first and second pairs of vanes respectively and third and fourth passages located in said stator member for communicating with said third and fourth ports respectively and with said second duct.

10. A rotary engine as in claim 9 wherein said exhausting means further comprises third and fourth valves disposed in said third and fourth ports respectively, and a cam shaft extending from one side wall of said rotor member into said stator member to actuate said third and fourth valves.

11. A rotary engine as in claim 2 wherein said igniting means is disposed in said rotor member between each pair of vanes.

12. A rotary engine comprising a generally annular stator member having a first and second pair of spaced apart sockets located in the periphery thereof, a rotor member having side walls and an interior peripheral wall and mounted to rotate about said stator member, said rotor member formed to define a combustion cavity and a compression cavity between the periphery of the stator member and the interior peripheral wall of the rotor member, said combustion cavity and compression cavity being disposed substantially 180° apart about the periphery of the stator member, a first and second pair of wedge-shaped vanes pivotally mounted at their vertices on the periphery of the stator member to pivot in and out of respective ones of said sockets as said rotor member rotates about the stator member, said vanes being mounted relative to said stator member such that the base of each vane pivots along an arc intersecting the center of the stator member, a cam track defined in at least one side wall of said rotor member, cam followers extending from at least one side of each vane and guided by said cam track to cause said vanes to pivot in and out of said sockets and to maintain sliding contact with the interior peripheral wall of said rotor member, means for introducing a fuel mixture into the spaces between each pair of vanes, means for igniting the fuel mixture between each pair of vanes, and means for exhausting the combustion products from the spaces between each pair of vanes.

* * * * *